United States Patent [19]

Wade

[11] Patent Number: 4,876,773

[45] Date of Patent: Oct. 31, 1989

[54] ENCLOSED CONTAINMENT APPARATUS FOR POSTMORTEM SETTINGS

[75] Inventor: James D. Wade, Marietta, Ga.

[73] Assignee: Kin, Inc., Atlanta, Ga.

[21] Appl. No.: 295,897

[22] Filed: Jan. 11, 1989

[51] Int. Cl.[4] ..... A61G 13/00

[52] U.S. Cl. ..... 27/23.1; 269/322; 600/21

[58] Field of Search ..... 27/23.1, 2, 19, 28; 269/322, 327; 600/20, 21, 22

[56] References Cited

U.S. PATENT DOCUMENTS

| | | | |
|---|---|---|---|
| 1,522,282 | 1/1925 | Beach et al. | 27/23.1 |
| 1,793,489 | 2/1931 | Johnson et al. | 27/23.1 |
| 3,529,590 | 9/1970 | Grosholz | 600/22 |
| 4,650,171 | 3/1987 | Holworth | 269/322 |
| 4,750,474 | 6/1988 | Dukhan et al. | 600/22 |
| 4,800,597 | 1/1989 | Healey | 600/21 X |

*Primary Examiner*—David A. Scherbel
*Assistant Examiner*—Richard E. Chilcot, Jr.
*Attorney, Agent, or Firm*—Needle & Rosenberg

[57] ABSTRACT

An enclosed containment apparatus for infection control in postmortem settings, comprising a table having a work surface, an hermetically sealed chamber assembly on the top of the table to provide a hermetically sealed environment above the work surface. The chamber comprises a door for providing access to work surface when opened in order to place a body within the interior of the chamber on the work surface, gloves extending into the chamber for working on the body, a transparent portion through which the work surface is visible, means for introducing decontaminant fluid into the interior of the chamber and means for draining the fluid away from the apparatus.

25 Claims, 4 Drawing Sheets

ENCLOSED CONTAINMENT APPARATUS FOR POSTMORTEM SETTINGS

BACKGROUND OF THE INVENTION

The present invention relates to the health field, and more particularly to a device for protecting workers, such as morgue and funeral home personnel, from blood and other body-fluid borne pathogens, as well as noxious odors, that may be emitted from corpses, particularly in autopsy and embalming settings.

Historically, the optimum criteria for precautionary infection control measures in postmortem settings were established out of concern for the potential infection of technical personnel by the hepatitis B virus (HBV). Hepatitis B, formerly known as serum hepatitis, is still the primary infection hazard of the health industry and funeral industry. However, since acquired immune deficiency syndrome (AIDS) was recognized as a public health problem in 1981, its infection potential has also become a very serious consideration.

In the United States, the principle mode of transmission of the HBV in the general population is sexual (homosexual and heterosexual). It is also transmitted by the shared needles of intravenous drug users. As it is a blood-borne virus, health care workers and other workers who are exposed to blood and body fluids are considered at risk for HBV infection.

In spite of vaccines against the HBV, the Center for Disease Control in Atlanta, Georgia (CDC) has recently reported that hepatitis B infection is steadily increasing in the United States with a possible 300,000 persons becoming infected annually. There are unpublished estimates of 500–600 annual hospitalizations of health-care workers who have become infected through exposure to blood, with over 200 deaths. (*Morbidity and Mortality Weekly Report, p.* 4, Aug. 21, 1987). The CDC believes that as many as 18,000 health-care workers may be infected annually with 10 percent of these becoming carriers. This unknown factor increases the risk for all workers exposed to blood and body fluids.

The AIDS virus has been called AIDS-associated retrovirus (ARV), human T-lymphotropic virus III (HTLV-III), lymphadenopathy-associated virus (LAV) and a combination of the last two (HTLV-III/LAV). Human immunodeficiency virus (HIV) is now the preferred term. Essentially, the epidemiology and disease transmission of the HIV is similar to those of the HBV. The HIV has a long and varied incubation period and can remain stable in dried blood for several days. It has been isolated from many body fluids and secretions, but like the HBV, it is primarily a blood-borne, sexually-transmitted disease.

Recent CDC statistics estimate 1.5 million HIV-infected persons in the general population of this country, though only 40,000 cases had been reported by August, 1987. It is estimated that there is a larger percentage of undiagnosed carriers of HIV than HBV. The number of reported cases is expected to increase to as many as 270,000 by 1991, and the CDC has declared AIDS an epidemic. As the number of people who are infected with the virus and the number of actual AIDS cases increases, the potential for exposure to workers at risk will also rise. Infection with the HIV is now considered to be small in comparison with HBV. However, any risk at all must be taken seriously because no drug has been developed to cure AIDS, and there is no vaccine to prevent it.

In addition to the HBV and HIV, there are many other blood-borne pathogens that merit concern in any consideration of infection potential. Some of these are hepatitis non-A and non-B, leptospirosis, malaria, rat-bite fever, relapsing fever, syphilis (primary and secondary stages), arthropod borne viral fevers such as Colorado tick fever, babesiosis and Creutzfeldt-Jakob disease.

In view of the possible risks and the present inability of medical assessment and examination to identify all patients infected with blood-borne viruses, especially HIV, the most recent CDC guidelines direct that all patients are to be considered infectious and that all autopsies are to also be considered infectious. "Universal precautions" or "universal blood and body fluid precautions" are terms coined by the CDC to describe a situation where protective barrier precautions are used in handling blood and body fluids from all patients. The use of gloves, waterproof clothing and other such items to prevent skin and mucous-membrane contact with blood or body fluids, and precautions to avoid injuries from needles and other sharp objects that could introduce infection into the bloodstream are primary components of universal precautions.

Other organizations are also involved in offering proposals for infection control and protection of health care workers. Among these are the National Committee for Clinical Laboratory Standards (NCCLS), the American Hospital Association (AHA) and the Labor Department's Occupational Safety and Health Administration (OSHA). Whatever their differences, all agree that protective barriers and special precautions are necessary for workers exposed to blood and body fluids. The OSHA proposal even includes the inspection of health-care facilities and fines for failure to enforce guidelines for the protection of health care workers.

Personnel performing postmortem procedures presently cannot avoid exposure to bone dust, blood and body fluids. Direct droplet contact by transport of viruses into the mouth, eyes or skin defects from accidental splashing or spattering of blood or body fluids is an ever present possibility in the autopsy room or embalming facility, and there is documentation of the transmission of the HBV from autopsy.

Traditional autopsy room clothing, consisting of scrub suits, shoe covers and surgical quality gloves, is not considered adequate for barrier protection. With the increased concern over HIV has come other recommendations for protective clothing for morgue and funeral home personnel. These include disposable jumpsuits that completely cover the body, hoods for the head and neck, safety goggles, double gloves and shoe covers, all of water impermeable materials. Formerly, masks were work at the discretion of those involved in postmortem procedures. Now, all guidelines require that masks be worn, and the more stringent proposals suggest the wearing of plastic face shields to cover the entire face and neck or safety goggles with cushion seals or wrap-around goggles for eyeglass wearers. Longer gloves, double gloves and those with improved safety features, such as mesh gloves for cutting bone, are also recommended.

There are also recommendations for modifying procedures to minimize spatters that might generate aerosol droplets, and for handling tissues and organs. For example, one such recommendation addresses the need to minimize exposure to airborne droplets during opening the skull. It suggests that the entire head of the cadaver be enclosed in a large plastic bag during the use of a bone saw to open the cranium. A hole is made in the bottom of the bag for the operator to use a hand saw instead of an electric saw. However, the bag typically does not remain inflated, causing the saw to cut the bag.

There exists a need, therefore, for a device which provides protection against blood-borne viruses and other pathogens for personnel engaged in postmortem examination procedures.

There also exists a need for such a device which not only isolates the pathogen, but will also contain spills or splashes and prevent spatter and mist from reaching the worker.

There exists a further need for such a device which facilitates disinfection procedures within a defined, enclosed work area.

There exists a still further need for such a device which permits personnel to work with a minimum of uncomfortable, restrictive personal barriers.

SUMMARY OF THE INVENTION

The present invention relates to an enclosed containment apparatus for infection control in postmortem settings, such as morgues, funeral homes, and tissue banks. The apparatus includes an autopsy table having a work surface and a chamber assembly sealingly connected to the table to provide a hermetically sealed environment above the work surface. Another embodiment of the present invention includes a modular chamber assembly with its own bottom work surface that can be placed upon any suitable support.

The box-like chamber assembly preferably has an elongated A-shaped profile with a forward side wall, a rearward side wall opposite the forward side wall, a first end wall provided between and sealingly connected to the forward and rearward side walls, a second end wall opposite the first end wall and provided between and sealingly connected to the forward and rearward side walls, and a top wall opposite the work surface and sealingly connected to the other walls to provide the sealed environment. The walls are constructed of transparent sheet material, such as polyvinyl chloride, so that a cadaver can be viewed by the operator when the body is placed on the work surface.

The chamber assembly also has a sealable door assembly for providing access for placing the cadaver on the work surface, the door assembly being movable between closed and open positions. In a preferred embodiment, the forward side wall is slidably mounted to the chamber assembly and opens in a gull-wing manner.

The chamber assembly also has a pair of gloves each extending hand first into the sealed device through a glove portal in the chamber assembly wall. The opened proximal end of each glove is sealingly attached to the chamber assembly. Furthermore, the assembly includes a plurality of rotating spray nozzles, preferably located on the inside portion of the top wall, for providing decontaminant fluids throughout the sealed environment and work surface. Also, means are provided within the chamber assembly to drain the fluids away from the apparatus.

In operation, the cadaver and work instruments are placed onto the work surface and the door assembly is closed. The body is then within a hermetically sealed environment. If desired, decontaminant fluid may be first sprayed throughout the interior of the chamber assembly, including the cadaver and instruments. The prosector places his hands into the gloves and, looking through the side walls, performs the autopsy. All airborne particles, including body parts, blood and pathogens are safely maintained within the closed environment of the chamber assembly. Once the autopsy is completed, decontaminant is once again sprayed through the environment, thereby destroying any pathogens therein. Once the body fluids and other liquids are drained from the table, the doors may be opened and the cadaver can then be removed.

It is an object of the present invention, therefore, to provide an apparatus which provides protection against blood-borne viruses and other pathogens for personnel in postmortem settings.

It is also an object of the present invention to provide an apparatus which will contain spill or splashes and prevent spatter and mist from reaching the worker.

It is a further object of the present invention to facilitate disinfection procedures within a defined, enclosed work area.

It is a still further object of the present invention to provide a device which permits personnel in postmortem settings to work with a minimum of uncomfortable, restrictive personal barriers.

These and other objects and advantages will be apparent from the drawings and following Detailed Description of the Invention.

BRIEF DESCRIPTION OF THE FIGURES OF DRAWINGS

DETAILED DESCRIPTION OF THE ILLUSTRATIVE EMBODIMENT

The device of the present invention provides a work area for autopsies and other post-mortem settings in which all procedure-generated splatters, splashes and mist are contained in an enclosed environment.

Figure 1:
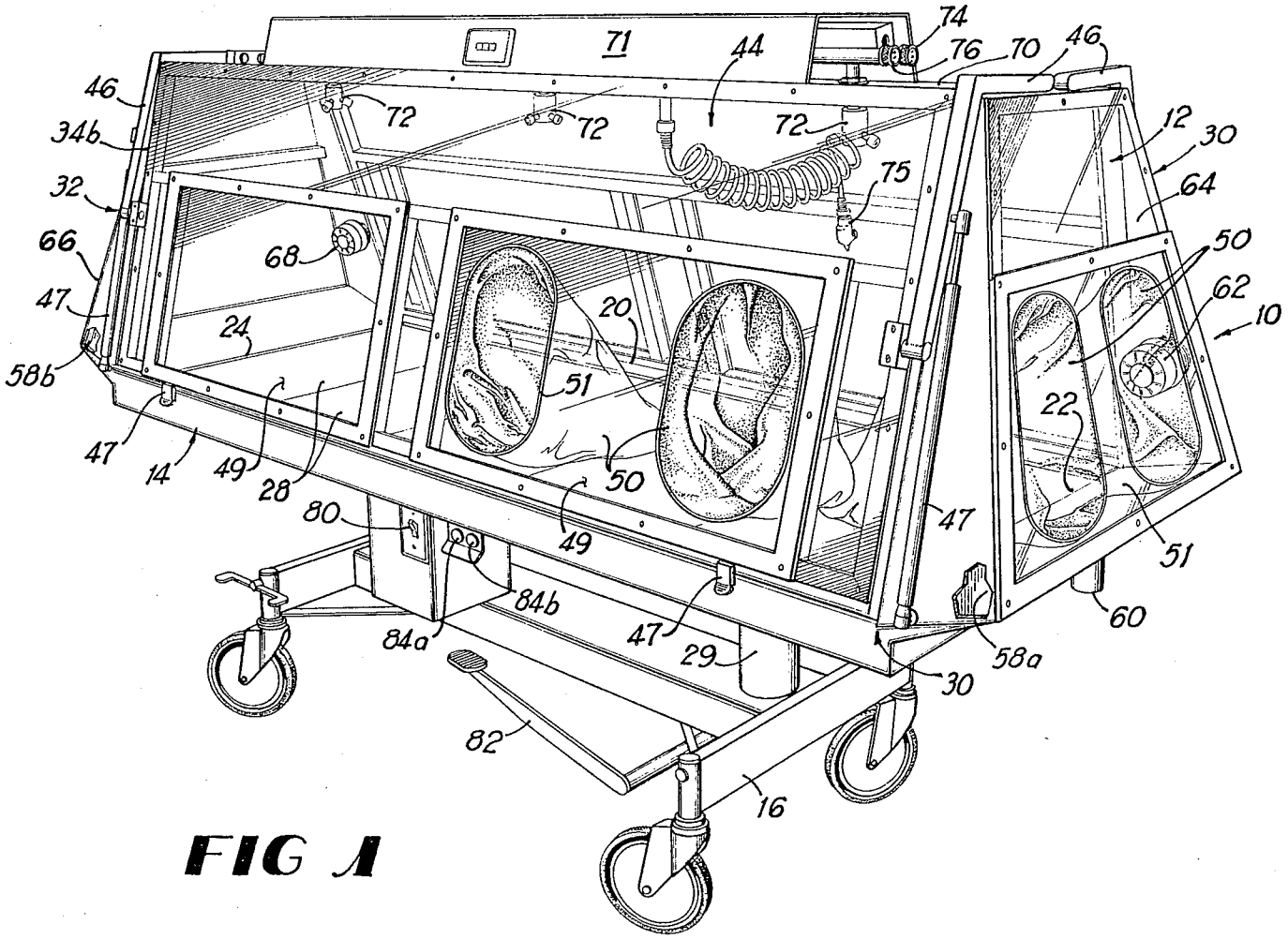
FIG. 1 is a perspective view of the present invention on an autopsy table.
Figure 2:
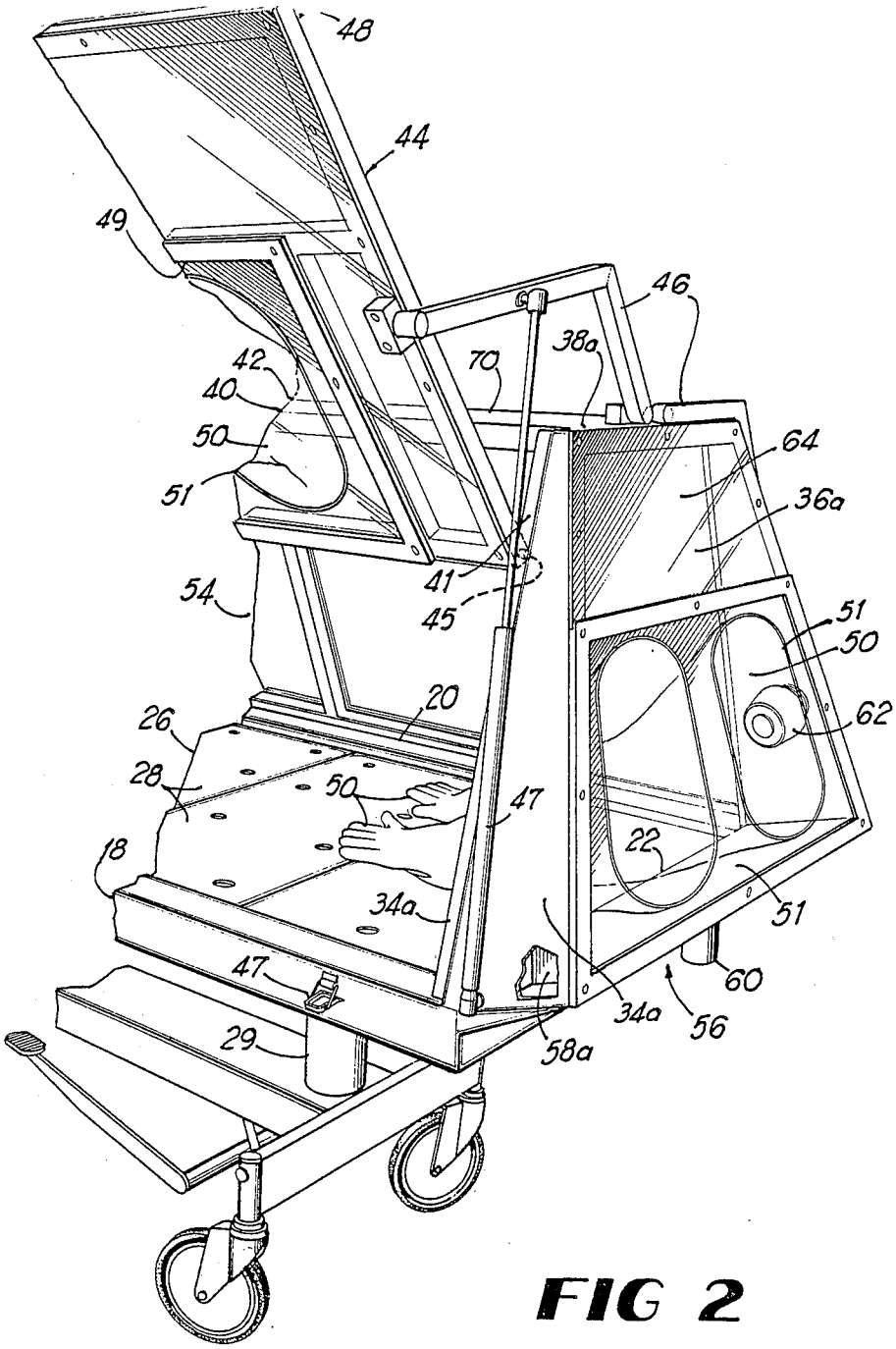
FIG. 2 is a partial perspective front view of the right end portion of the present invention showing the forward side wall in the open position.

Referring to FIGS. 1 and 2, the device 10 comprises a chamber assembly 12 securely attached to the top of a work table 14. The chamber assembly 12 and the table 14 are held above the floor by supporting means or a base 16.

The work table 14 may be a conventional autopsy table and is preferably rectangular in shape, including a front edge 18, a rear edge 20, a first side edge 22 and a second side edge 24. The work surface 26 of the table 14 may consist of a plurality of removable, perforated stainless steel grid plates 28 for allowing drainage of solutions and bodily fluids from the table 14 through drain 29.

The chamber assembly 12 is located atop and essentially overlies the work table 14. The work surface 26 may be either built directly onto the chamber assembly bottom, or may be a part of a table 14 upon which the chamber assembly 12 is placed. The assembly 12 has a frame consisting of an A-shaped first end frame 30 extending upwardly from the first side edge 22 of the table 14, and an A-shaped second end frame 32 extending upwardly from the second side edge 24 of the table 14. Each end frame 30,32 has a forward end frame member 34*a,b*, a rearward end frame member 36*a,b*, and a top end frame member 38*a,b* located between and attached at opposite ends to the forward and rearward end frame members 34,36. The length of the top end frame member 38 is less than that of its corresponding table side edge 22,24 so that the forward and rearward frame members 34,36 slope inwardly towards the top end frame member 38. A horizontally oriented forward connecting frame member 40 is attached at one end to the top of the forward end frame member 34*a* of the first end frame 30 and at the opposite end to the top of the forward end frame member 34*b* of the second end frame 32. A horizontally oriented rearward connecting frame member 42 is attached at one end to the top of the rearward end frame member 36*a* of the first end frame 30 and at the opposite end to the top of the rearward end frame member 36*b* of the second end frame 32. It is preferred that the end frames 30,32 and connecting frame members 40 and 42 be comprised of one inch square, 16 gauge Type 304 stainless steel tubing.

Figure 4:
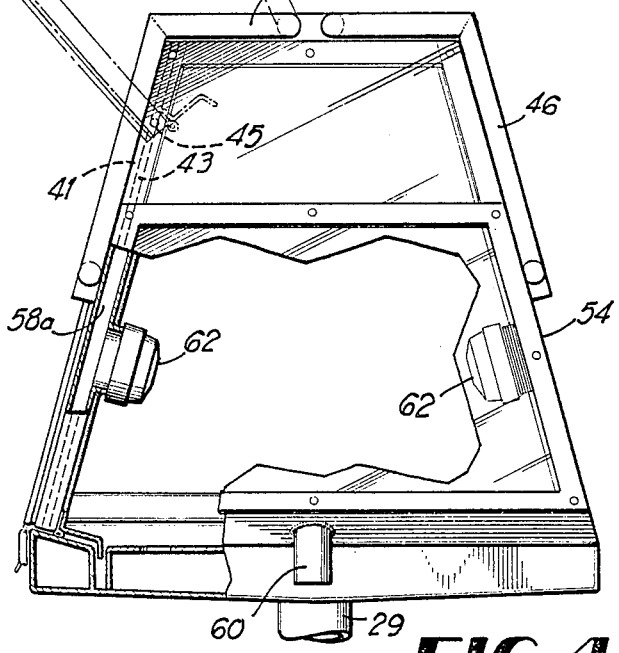
FIG. 4 is an end view of the present invention taken along line 4—4 in FIG. 3 with certain elements broken away from clarity.

A forward side wall 44 is located between the forward end frame members 34*a,b* along the front edge 18 of the table 14. The forward side wall 44 is liftable so that a cadaver can be easily placed upon the work surface 26 of the table 14. As seen in FIGS. 1, 2 and 4, the forward side wall 44 is comprised of a square stainless steel framework surrounding a sheet of transparent material which is glare-resistant and impervious to decontamination solutions. One such material has been found to be 3/16" sheet polyvinyl chloride (PVC).

A first L-shaped door bracket 46 is pivotally connected at a first end to the top end frame member 38*a* of the first end frame 30 and at a second end to the approximate midpoint of a first side edge of the forward side wall 44. In a similar manner, a second L-shaped door bracket is pivotally connected at a first end to the top end frame member 38*b* of the second end frame 32 and at a second end to the approximate midpoint of a second side edge of the forward side wall 44. A first gas spring door actuator 47 has a stabilized end and a piston end pivotally attached to the L-shaped bracket.

Figure 5:
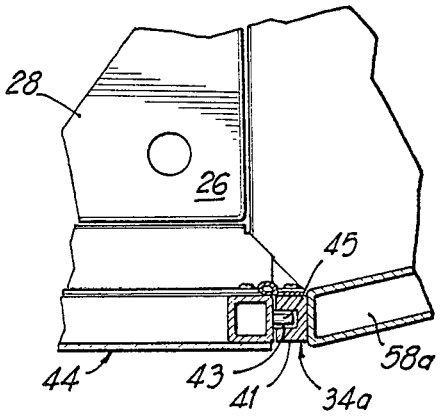
FIG. 5 is a top view of a section to the present invention taken along line 5—5 in FIG. 3.
Figure 6:
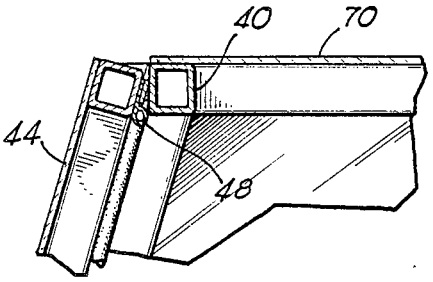
FIG. 6 is a view of a section of the present invention taken along line 6—6 in FIG. 3.

Referring to FIGS. 2 and 5, a door guide 41 having a lug accepting groove 43 is provided on each forward end frame member 34*a,b*. A door guide lug 45 is provided on the lower portion of each forward side wall and extends horizontally into a lug accepting groove 43. In this manner, when the forward side wall 44 is lifted, the lugs 45 glide upward along the lug grooves and the L-shaped door brackets pivot. The door actuators facilitate the lifting of the forward side wall 44 and hold the side wall 44 in an opened position. The side wall 44 can be closed by application of a downward force. It is important that gaskets be proved along the periphery of the forward side wall 44 to maintain an adequate seal when the device is closed, as seen in FIG. 6. Also, an upper seal 48 should be provided along the top edge of the forward side wall 44 for contacting and creating a seal with the forward connecting member. Latches 47 may be provided for locking the side wall 44 in a closed position.

The forward side wall 44 may consist of a single sheet of the above described transparent material, or, as shown in FIG. 1, may comprise a plurality of removable sections 49. In either case, the side wall 44 has at least one pair of glove ports. A glove 50, preferably made of PVC, extends hand first into the chamber assembly through each port. The open edge 51 of the proximal end of the glove 50 is sealingly attached to the peripheral edge of the port such as by gluing with a polymeric sealant or heat sealing. It is preferred that the ports and attached gloves 50 be provided on a removable section 49 of wall material, which then may be removably attached over a window in the side wall 44. This will enable a new section 49 to be substituted for an old section having worn or damaged gloves 50. Alternatively, the gloves 50 may be sealed directly to the side wall 44 itself.

A rear sidewall 54 is positioned opposite the forward side wall above the rear edge 20 of the table 14 and between the rearward end frame members 36*a,b*. The rear side wall 54 may be a lift door-line assembly similar to the forward side wall 44, or may be a single sheet of transparent material sealingly attached to the frame. Similarly, gloves 50 may be provided through the wall 54.

Figure 3:
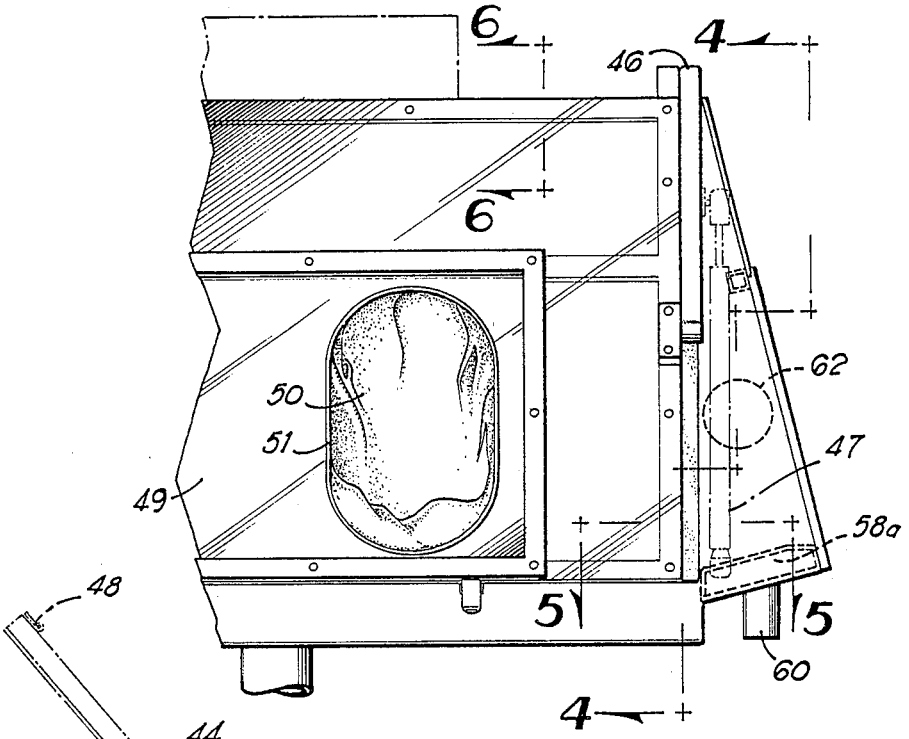
FIG. 3 is a partial side view of the right end portion of the present invention.

A first end wall assembly 56, shown in detail in FIGS. 2, 3 and 4, is provided along the first side edge 22 of the table 14. A first U-shaped manifold 58*a* having a plenum chamber is sealingly connected to the first end frame 30. Air-intake means 60 provide air from an outside source, such as a position displacement pump (not shown), into the plenum chamber, and air flows through the chamber and is expelled into the interior of the chamber assembly via a pair of air input nozzles 62. Replaceable HEPA and/or activated charcoal filters should be provided over the nozzles 62 to prevent introduction of extraneous outside materials. The charcoal filters act to capture vapors.

A transparent first end wall 64 is sealingly attached to the manifold 58*a*. The end wall 64 may consist of a single sheet of transparent material, or, similar to the forward side wall 44, may have a removable section with attached gloves 50. Also, the end wall 64 may be made liftable in the manner similar to the forward side wall 44.

A second end wall assembly 66 is provided along the second side edge 24 the table 14, and may have a construction similar to that of the first end wall assembly 56 described above. A second manifold, similar to the first manifold 58*a*, is provided having a pair of exhaust nozzles 68 for removing air from the chamber assembly 12. A HEPA and/or activated charcoal filter is provided on each exhaust nozzle 68 for preventing escape of airborne pathogens and other particulates with the exhausted air. Air out-take means (not shown) may be provided to remove air from the plenum chamber.

The device 10 also has a top wall 70 sealingly attached to the forward connecting frame member 34*a,b*, the rearward connecting frame member 34*a,b*, and the top end frame members 38*a,b*. It is preferable that the top wall 70 be made of transparent material, and that a light assembly 71 be attached to the top wall for lighting the inside of the device.

Means for spraying a decontamination solution, such as sodium hypochlorite or phenolic solutions, inside the device 10 is provided. A plurality of spinning spray nozzles 72 are attached to the inner surface of the top wall 70 and are connected through the top wall 70 to a first decontamination solution conduit 74 which is connected to an outside source of decontamination solution (not shown). A hand sprayer 75 is also provided inside the device 10, and is connected through the top wall 70 to a conduit 76 capable of delivering water or decontamination solution from an outside source (not shown).

Waterproof electrical outlets 77 may be provided on the inner surface of the top wall 70 for powering electric instruments used during the autopsy procedure. It is preferable that the outlets be placed closely above the spray nozzles 72 so as to minimize contact with spraying solution.

The table 14 and chamber assembly 12 are held above the floor by supporting means, such as a standard autopsy table base 16. The base 16 may be modified to include a switch 80 for activating the lights 71, as well as means for raising and lowering the table 14. For example, a foot lever 82 may be provided for manually altering the height of the table 14 while the prosector's hands are in the gloves 50. Also, means for adjusting the slope of the table 14 are provided to assisting the flow of solution and body fluids along the work surface 26 to a drain 29. The table 14 may also be sloped to allow prosector's of different heights to use the device 10 simultaneously.

In a typical autopsy procedure, the forward side wall 44 is lifted open, as shown in FIG. 2, and a cadaver is placed onto the work surface 26. Instruments used in performing the procedure are also set into the device 10. The front side wall 44 is closed and latched, and air is circulated into the device 10 from the input nozzles 62 and removed through the exhaust nozzles 68. The circulating air prevents fogging of the device walls caused by the presence of a warm cadaver, and also helps trap airborne pathogens in the filters of the exhaust nozzles 68.

The cadaver may then be pre-washed if desired, with decontamination solution sprayed from the rotating spray nozzles 72, and the prosector then places his hands in the gloves 50 and performs the desired procedure. During an autopsy procedure, blood and other body fluids typically splatter against the inside portions of the chamber assembly 12 and work surface 26. Also, particulate matter such as bone dust becomes airborne. To destroy viruses such as HIV and HBV often associated with such fluids and particulate matter, decontamination solution is once again sprayed from the rotating spray nozzles 72 onto the cadaver, the inside portions of the chamber assembly 12 and work surface 26, and the instruments. The spraying solution also captures airborne pathogens. The hand sprayer 75 may used to supplement the decontamination spraying procedure if necessary. The solution, body fluids and captured matter are then drained from the device 10.

Once the decontamination procedure is complete, the forward side wall 44 may be lifted and the cadaver removed. Because the forward side wall 44 is lifted at an angle, any solution remaining on its inner portion will drip onto the work surface 26 and drain out of device 10. The final result is that the autopsy is performed without exposing the prosector to the pathogens.

It is important that all joints, openings, and other points of potential access through the walls of the device be properly sealed to prevent escape of pathogens. To this end, polymeric sealants or neoprene gaskets should be provided around all connecting surfaces, and regular inspection should be made to insure the integrity of the device.

It should be noted that while the device is described herein for use during an autopsy procedure, it may also be used wherever a containment device for infection control may be necessary. For example, the device may also be useful in protecting funeral home and tissue bank personnel.

The above-described chamber assembly 12 has essentially an open bottom with the top surface of an autopsy table providing the working surface upon which the body is laid. However, another embodiment of the present invention (not shown) is to provide a modular chamber assembly with its own bottom work surface having its own drainage system that could be placed upon the top of any support, such as a convention table.

What is claimed is:

1. An autopsy device, comprising:

(a) a work surface upon which a body may be placed;

(b) an hermetically sealed chamber assembly on said work surface, at least a portion of said chamber assembly being movable between closed and opened positions to allow said body to be placed within said chamber assembly on said work surface, said chamber assembly further comprising:

(i) means for providing access of the hands of an operator into the interior of said chamber assembly when said chamber assembly is in said closed position; and (ii) a transparent portion to allow said operator to view said body on said work surface;

(c) means for providing a decontaminant fluid to said interior of said chamber assembly and said work surface; and (d) means for removing said decontaminant fluid from said device.

2. The autopsy device of claim 1, wherein said portion of said chamber assembly comprises a sealable door assembly to allow said body to be placed on said work surface.

3. The autopsy device of claim 1, wherein said means for providing access of the hands of an operator comprises a plurality of gloves each extending hand first into said interior of said chamber assembly and attached at the proximal end of said gloves to said chamber assembly.

4. The apparatus of claim 1, wherein said chamber assembly comprises:

a pair of opposed side walls, a pair of end walls on opposite ends of side walls, said side end wall terminating in a top wall, said decontaminant fluid providing means being on said top wall.

5. The apparatus of claim 3, wherein said chamber assembly has a window, and further comprising a glove panel capable of being removed from and sealingly attached to said chamber assembly around said window, said glove panel having said glove so that said glove extends into said chamber assembly interior through said window when said glove panel is attached to said chamber assembly.

6. The apparatus of claim 3, wherein said glove is removably attached to said chamber assembly.

7. The apparatus of claim 1, and further comprising means for delivering air from an outside source into said interior of said chamber assembly, means for exhausting air from said interior of said chamber assembly and an air filter means positioned between said air delivery means and said interior.

8. The apparatus of claim 1, wherein said chamber assembly further comprises a first manifold having a plenum chamber, air-intake means for delivering air from an outside source to said plenum chamber, and an air input nozzle for delivering air from said plenum chamber into said interior of said chamber assembly.

9. The apparatus of claim 1, wherein said chamber assembly further comprises a second manifold having a plenum chamber, an exhaust nozzle for removing air from said chamber assembly interior to said plenum chamber, and air out-take means for removing air from said plenum chamber.

10. The apparatus of claim 1, wherein said means for providing a decontaminant fluid throughout said interior of said chamber assembly comprises:

(a) a conduit for carrying decontaminant from an outside source through said chamber assembly into said chamber assembly interior; and (b) a spray nozzle located inside said chamber assembly in fluid communication with said conduit and capable of spraying said decontaminant fluid throughout said interior.

11. The apparatus of claim 10, wherein said spray nozzle is rotatable and comprises a plurality of spray outlets.

12. The apparatus of claim 1, wherein said work surface has a forward edge, a rearward edge opposite said forward edge, a first side edge, and a second side edge opposite said first side edge, and wherein said chamber assembly comprises a first A-shaped end frame having a forward end frame member and a rearward end frame member extending upwardly from said first side end of said work surface and a second A-shaped end frame having a forward end frame member and a rearward end frame member extending upwardly from said second side end of said work surface, a forward side wall positioned between said forward frame members of said end frames, a rearward side wall positioned between said rearward end frame members of said end frames, a first end wall positioned between said forward end frame member and said rearward end frame member of said first end frame, and a second end wall positioned between said forward end frame member and said rearward end frame member of said second end frame.

13. The apparatus of claim 12, wherein said forward side wall is comprised of a sheet of transparent material.

14. The apparatus of claim 12, wherein said rearward side wall is comprised of a sheet of transparent material.

15. The apparatus of claim 12, wherein said first end wall is comprised of a sheet of transparent material.

16. The apparatus of claim 12, wherein said second end wall is comprised of a sheet of transparent material.

17. The apparatus of claim 12, wherein said top wall is comprised of a sheet of transparent material.

18. The apparatus of claim 1, and further comprising means for adjusting the slope of said work surface.

19. The apparatus of claim 12, wherein said forward side wall is movable between open and closed positions.

20. The apparatus of claim 12, wherein said rear side wall is movable between open and closed positions.

21. The apparatus of claim 12, wherein said first end wall is movable between open and closed positions.

22. The apparatus of claim 12 wherein said second end wall is movable between open and closed positions.

23. The autopsy device of claim 1, wherein said work surface is attached to the bottom of said chamber assembly.

24. The autopsy device of claim 1, wherein said work surface is provided on a base separate from said chamber assembly.

25. An autopsy device sealingly attachable to a work surface, comprising:

(a) an hermetically sealed chamber assembly on said work surface, at least a portion of said chamber assembly being movable between closed and opened positions to allow said body to be placed within said chamber assembly on said work surface, said chamber assembly further comprising:

(i) means for providing access of the hands of an operator into the interior of said chamber assembly when said chamber assembly is in said closed position; and (ii) a transparent portion to allow said operator to view said body on said work surface;

(b) means for providing a decontaminant fluid to said interior of said chamber assembly and said work surface; and (c) means for removing said decontaminant fluid from said device.

* * * * *